United States Patent [19]

Schumacher

[11] 4,014,072

[45] Mar. 29, 1977

[54] FASCIA AND TRACK FOR A SLIDING DOOR

[75] Inventor: William J. Schumacher, Downey, Calif.

[73] Assignee: Acme General Corporation, San Dimas, Calif.

[22] Filed: Oct. 30, 1975

[21] Appl. No.: 627,046

[52] U.S. Cl. ..... 16/95 R; 16/96 R; 160/38

[51] Int. Cl.[2] ..... A47H 1/04

[58] Field of Search ..... 16/87 R, 87.4 R, 87.4 W, 16/93 R, 94 R, 95 R, 96 R; 160/19, 38, 39; 52/242; 248/224; 49/409

[56] References Cited

UNITED STATES PATENTS

| | | | |
|---|---|---|---|
| 2,676,483 | 4/1954 | Nelsson | 52/242 |
| 2,728,101 | 12/1955 | Cowdroy | 16/88 |
| 2,893,049 | 7/1959 | Guerrant | 16/96 R |
| 3,165,287 | 1/1965 | Parsons | 248/224 |
| 3,217,452 | 11/1965 | Steele | 52/242 |
| 3,473,266 | 10/1969 | Miller | 49/504 |
| 3,650,071 | 3/1972 | Tanner | 49/409 |
| 3,925,948 | 12/1975 | Sauer et al. | 52/242 X |

*Primary Examiner*—George H. Krizmanich
*Attorney, Agent, or Firm*—Christie, Parker & Hale

[57] ABSTRACT

A combined track for hanging doors and fascia in which the fascia has an inverted lip that engages a series of clips along the side of the track. The clips, which are integrally formed from the rolled sheet metal of the track, provide slots which are frictionally engaged by the inverted lip of the fascia to secure the fascia in position.

4 Claims, 1 Drawing Figure

FASCIA AND TRACK FOR A SLIDING DOOR

FIELD OF THE INVENTION

This invention relates to overhead tracks for supporting sliding or folding doors, and more particularly, is concerned with a two-piece track and fascia assembly constructed from rolled sheet metal.

BACKGROUND OF THE INVENTION

The use of metal tracks as an overhead support for sliding doors or panels is well know. Conventionally a double track for supporting two panels is provided, the track being either extruded of aluminum or rolled from sheet steel. The track is generally a simple channel shape with the projecting edges of the channel being rolled over to form V-shaped grooves along which the supporting rollers for the doors or panels roll. The track is mounted by securing it against a flat overhead surface, such as a door jamb, by suitable screws. Usually some form of fascia to cover the track and give a finished appearance to the overhead support is provided. The fascia plate may be made of wood trim or may be a metal plate which is integrally formed with the track. The wood fascia trim of course presents an installation problem if it is to look nice. An integral metal fascia plate, while greatly simplifying the installation, presents a problem if the tracks must bend somewhat to fit the contour of the overhead door jamb on which the track is mounted. With the integral fascia extending substantially at right angles to the jamb, any bending of the track to fit the contour of the jamb causes the surface of the fascia to buckle or wrinkle.

SUMMARY OF THE INVENTION

The present invention provides an arrangement of supporting a rolled sheet metal fascia from a rolled sheet metal track. The supporting arrangement allows the track to bend to conform to the contour of the overhead jamb while permitting the fascia to be movable vertically relative to the track so as to relieve any strain on the fascia which otherwise might cause it to buckle or wrinkle.

In brief, this is accomplished by providing a series of integral clips formed along one side of the track, each clip forming an upwardly facing slot. The sheet metal fascia having a decorative face is formed with an inverted or downwardly extending flange along the inside of the top edge. The flange is positioned in the slot formed by the clips, the clips clamping the flange against the side of the track. Thus the fascia is held in place by the friction between the surface of the track and the inverted flange, allowing relative movement between the track and the fascia along the interface between the track and the flange of the fascia.

DESCRIPTION OF THE DRAWINGS

For a better understanding of the invention, reference should be made to the accompanying drawing, wherein the single FIGURE is a perspective view of the track and fascia in a disassembled condition.

DETAILED DESCRIPTION

Figure 1:
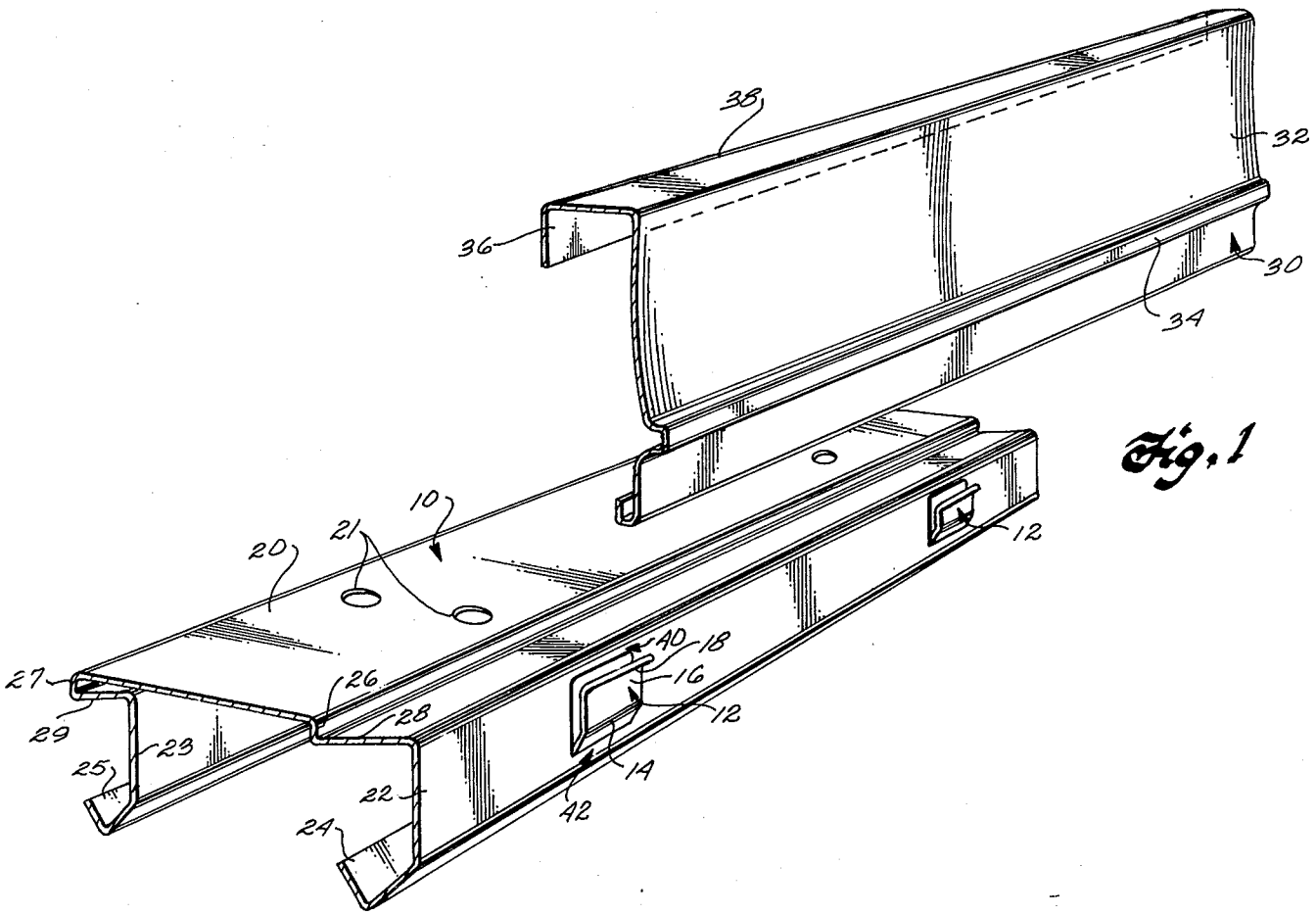

Referring to the drawing in detail, the numeral 10 indicates generally an overhead track for the support of sliding panels or doors (not shown). The track is roll-formed from a flat strip of sheet metal. Before roll-forming, the sheet goes through a stamping operation in which a plurality of clips 12 are formed at spaced intervals along the length of the sheet metal strip. Typically the clips 12 are spaced at 1 foot intervals but may be more widely spaced, particularly in longer length tracks. The clips 12 are formed by a stamping operation in which a three-sided cut in the metal is made and the resulting tab then formed to include an offsetting portion 14, a flat clamping portion 16, and an outwardly curved edge portion 18.

After the integral clips 12 are formed, the flat strip of sheet metal is rolled into the desired shape to provide a double track. The rolling operation forms the sheet metal into a generally channel shape so as to provide a flat longitudinal portion 20 and a pair of side portions 22 and 23. The portion 20 is adapted to be secured against an overhead jamb or other supporting horizontal surface by screws, bolts, or other suitable means (not shown). A series of holes 21 may be preformed during the stamping operation for this purpose. The two track portions are formed to include V-shaped grooves 24 and 25 along the margins which are adapted to receive supporting rollers (not shown) from which the door panels are hung. The V-shaped groove portions 24 and 25 are supported at the lower margin of vertical side portions 22 and 23, respectively. The vertical portion 22 is joined to flat portion 20 by an intermediate section 28 which extends over the top of the groove 24 at an angle and terminates in ridge 26 to retain the wheels in the groove when the sliding panel is in place. Similarly the portion 23 is joined to the portion 20 by an intermediate section 29 terminating in a ridge 27 above the groove 25.

The vertical extent of the clip 12 is made somewhat less than the vertical extent of the vertical portion 22. The clip is positioned so as to leave flat surfaces 40 and 42 between the margins of the vertical portion 22 and the top and bottom edges of the clip 12. This construction allows clips to be formed prior to the roll-forming operation without distorting the rolled track or interfering with the conventional rolling operation.

A sheet metal fascia member 30 is also rolled from a separate sheet metal strip to provide a decorative front surface 32 which may have a ridge 34 extending along the length thereof to provide a stiffening effect as well as a decorative effect. The upper margin of the front face 32 is rolled into a channel shape, providing an inverted lip 36 projecting downwardly from a top surface 38. The lower margin of the front face 32 of the fascia 30 is also rolled to a channel shape to provide a smooth lower margin to the fascia and at the same time add rigidity to the fascia.

As shown in the drawing, the track and fascia are shown in the disassembled condition. The fascia is assembled on the track by inserting the inverted lip 36 along the upper margin of the fascia 30 into the slots formed between the clips 12 and the vertical portion 22 of the track. The track is formed of a sheet metal material having a sufficiently high yield and stiffness that the clips act as cantilever springs, exerting a substantial clamping pressure against the inverted lip 36 when it is wedged into the slots formed by the clips 12. The force is sufficient that the weight of the fascia is supported by the frictional force between the inverted lip 36 and the vertical portion 22 of the track 10.

The fascia 30 is assembled with the track 10 prior to installation. The assembly can be performed by the manufacturer so that the installer receives the track and fascia in pre-assembled condition. The clips 12 allow a reasonable amount of relative vertical movement between the track and the fascia. Thus any slight bending of the track 10 to conform to the surface of the jamb during installation does not tend to buckle or wrinkle the fascia. Thus the fascia floats vertically within limits defined by the space between the rounded upper edge 18 of the clips and the overhead surface against which the track is secured. This space is less than the vertical extent of the inverted lip 36 so that the fascia cannot become disengaged from the slots formed by the clips 12 once the track and fascia assembly is mounted in position against the door jamb.

While a track for sliding doors or panels has been shown and described in detail, the invention is also applicable to tracks of various types, such as tracks for folding or accordian type doors. It also will be appreciated that the track may be made to accommodate a fascia on both sides of the track, if desired.

What is claimed is:

1. A track assembly for supporting doors from an overhead horizontal surface, comprising: a longitudinal track member having a normally vertical surface along at least one side of the track, clip means spaced longitudinally on said surface, the clip means including upwardly projecting fingers integral with the side of the track forming slots between the fingers and said surface; and a fascia member having an elongated outer surface and an inverted lip along one margin, the lip extending downwardly and engaging said slots, the fingers of the clip means clamping the inverted lip against the vertical surface of the track member to frictionally secure the fascia in position so that the vertical position of the fascia can be adjusted relative to the track member.

2. Apparatus of claim 1 wherein the track is made of thin sheet material and the fingers of the clip means are integrally formed with the track by offsetting tab portions of the sheet material along said vertical surface to provide said fingers.

3. Apparatus of claim 2 wherein the vertical surface extends substantially above and below the margin of the fingers.

4. A track and fascia combination comprising:

a channel-shaped sheet metal track;

means for connecting the track to an overhead horizontal surface;

a plurality of spaced clip means along one side of the track forming upwardly opening slots; and a sheet metal fascia having an upper edge for abutting the overhead surface terminating on one side in a decorative face and a downwardly extending flange on the opposite side of the edge, the flange having a thickness greater than the thickness of at least a portion of the slot for tight frictional engagement therewith, and a vertical extent relative to the depth of the slot sufficient ot accommodate vertical displacement of the fascia relative to the track when the track is connected to an overhead surface, the clip means comprising a plurality of fingers integrally formed from the sheet metal side of the track by offsetting a portion of the sheet metal outwardly from the side of the track, the fingers projecting upwardly toward the overhead surface, the flange of the fascia wedging between the offset fingers and the adjacent surface of the track to provide vertical adjustment of the fascia relative to the track after the track is mounted against the overhead surface.

* * * * *